US011739977B2

(12) United States Patent
Gee et al.

(10) Patent No.: US 11,739,977 B2
(45) Date of Patent: Aug. 29, 2023

(54) CONDENSATE PUMP ASSEMBLY

(71) Applicant: ASPEN PUMPS LIMITED, East Sussex (GB)

(72) Inventors: Christopher Gee, East Sussex (GB); Christopher Forshaw, East Sussex (GB); Joseph Sharpstone, East Sussex (GB); Gary Haffenden, East Sussex (GB)

(73) Assignee: ASPEN PUMPS LIMITED, East (GB)

( * ) Notice: Subject to any disclaimer, the term of this patent is extended or adjusted under 35 U.S.C. 154(b) by 686 days.

(21) Appl. No.: 16/635,737

(22) PCT Filed: Jul. 27, 2018

(86) PCT No.: PCT/GB2018/052119
§ 371 (c)(1),
(2) Date: Jan. 31, 2020

(87) PCT Pub. No.: WO2019/025765
PCT Pub. Date: Feb. 7, 2019

(65) Prior Publication Data

US 2021/0131700 A1 May 6, 2021

(30) Foreign Application Priority Data

Aug. 2, 2017 (GB) ..... 1712431

(51) Int. Cl.
*F24F 13/22* (2006.01)
*F24F 140/30* (2018.01)
*F04D 29/64* (2006.01)

(52) U.S. Cl.
CPC ..... *F24F 13/222* (2013.01); *F04D 29/64* (2013.01); *F24F 2140/30* (2018.01)

(58) Field of Classification Search
CPC ..... F24F 2140/30; F24F 13/22; F24F 13/222
See application file for complete search history.

(56) References Cited

U.S. PATENT DOCUMENTS 4,554,794 A * 11/1985 Khan ..... F24F 13/222 200/61.07
2009/0071181 A1 3/2009 Spanger
(Continued)

FOREIGN PATENT DOCUMENTS

GB 2544756 A * 5/2017 ..... F04D 13/16
GB 2544756 A 5/2017
WO 2011130631 A2 10/2011

OTHER PUBLICATIONS

International Search Report for Application No. PCT/GB2018/052119 dated Oct. 4, 2018, 6 pages.
(Continued)

*Primary Examiner* — Lionel Nouketcha
(74) *Attorney, Agent, or Firm* — Seyfarth Shaw LLP

(57) ABSTRACT

There is provided a condensate pump assembly (100) for use in an air conditioning system. The condensate pump assembly (100) comprises a pump (102) arranged in a housing (104) to pump liquid from a liquid inlet (116) towards a liquid outlet (106). The condensate pump assembly (100) further comprises a liquid receptacle (108) arranged, in a first position in the housing (104), to receive condensate from a condensate inlet (110) and to be in fluid communication with the liquid inlet (116). The liquid receptacle (108) is movable to a second position removed from the housing (104), whereby to empty the liquid receptacle (108). The condensate pump assembly (100) further comprises selective release (112, 114) means operable by a hand of a user to release the liquid receptacle (108) for movement from the first position towards the second position.

14 Claims, 5 Drawing Sheets

(56) References Cited

U.S. PATENT DOCUMENTS

| | | | | |
|---|---|---|---|---|
| 2011/0272043 | A1 | 11/2011 | Hollingsworth et al. | |
| 2016/0131372 | A1* | 5/2016 | Choi | F24F 3/1411 62/189 |
| 2016/0334155 | A1* | 11/2016 | Sjogren | F24F 13/20 |

OTHER PUBLICATIONS

Written Opinion for Application No. PCT/GB2018/052119 dated Oct. 4, 2018, 8 pages.

* cited by examiner

CONDENSATE PUMP ASSEMBLY

CROSS REFERENCE TO RELATED APPLICATIONS

This is a National Stage application of, and claims priority to, PCT/GB2018/052119, filed Jul. 27, 2018, which claims priority to GB Patent Application No. 1712431.4, filed Aug. 2, 2017, the disclosures of which are incorporated herein by reference in their entirety.

This invention relates to a condensate pump assembly for use in an air conditioning system and a kit of parts for forming the same.

BACKGROUND

Condensate pump assemblies are used to pump liquid condensate from appliances that produce condensate, for example an air conditioning system, a condensing boiler system or a refrigerator, out of a room or building. In a typical air conditioning system, the air conditioning unit produces liquid condensate, i.e. water, which drains from the air conditioning unit to a liquid reservoir in the form of a liquid receptacle in a condensate pump assembly mounted to a wall of the room or building, typically below the air conditioning unit. When the liquid receptacle is sufficiently filled with liquid, the liquid is pumped from the liquid receptacle via a liquid inlet and away from the condensate pump assembly, for example outside the room, via a liquid outlet. After sustained operation of the condensate pump assembly, contaminants such as dirt may enter the liquid receptacle and are not removed by the pump. The liquid receptacle can be made removable from a housing of the condensate pump assembly to allow cleaning of contaminants from the liquid receptacle.

In condensate pump assemblies of the prior art, a clamshell cover is affixed to the condensate pump assembly to secure the liquid receptacle in place in the condensate pump assembly, as well as to act as a sheath to improve the aesthetic appearance of the condensate pump assembly by hiding the liquid receptacle from view. Not only do such covers require two hands to remove, they also increase the size of the condensate pump assembly and create an additional source of noise by rattling against a housing of the condensate pump assembly during operation of the pump.

The present disclosure seeks to provide at least an alternative to condensate pump assemblies of the prior art.

BRIEF SUMMARY OF THE DISCLOSURE

In accordance with the present disclosure there is provided a condensate pump assembly for use in an air conditioning system. The condensate pump assembly comprises a pump arranged in a housing to pump liquid from a liquid inlet towards a liquid outlet. The condensate pump assembly further comprises a liquid receptacle arranged, in a first position in the housing, to receive condensate from a condensate inlet and to be in fluid communication with the liquid inlet. The liquid receptacle is movable to a second position removed from the housing, whereby to empty the liquid receptacle. The condensate pump assembly further comprises selective release means operable by a hand of a user to release the liquid receptacle for movement from the first position towards the second position.

Thus, the liquid receptacle of the condensate pump assembly can be removed from the housing for emptying without requiring a two-handed operation. This is useful because the condensate pump assembly can sometimes be mounted in confined or difficult to reach locations, where it may be difficult to access the liquid receptacle. One-handed operation of the selective release means allows the user to easily move the liquid receptacle from the first position towards the second position for emptying or cleaning of the liquid receptacle. The selective release means is operable one-handed by the user to release the liquid receptacle for movement from the first position towards the second position. It will be understood that the term one-handed does not require one particular hand of the user and in some embodiments, the user may use either hand to operate the selective release means.

The release means may comprise a resilient member biased to hold the liquid receptacle in the first position and movable to release the liquid receptacle for movement from the first position towards the second position.

The resilient member may be provided on the liquid receptacle. The resilient member may be biased to engage with a corresponding lip provided on the housing.

The liquid receptacle may be secured in the first position only by the selective release means.

The selective release means may be operable from a base surface of the condensate pump assembly, when the condensate pump assembly is mounted for use.

A base portion of the liquid receptacle may provide an outer surface of the condensate pump assembly. Thus, the condensate pump assembly need not be provided with a removable cover. The lack of a removable cover reduces the noise of the condensate pump assembly from rattling during operation of the pump, unlike condensate pump assemblies of the prior art. Furthermore, the condensate pump assembly has fewer components since the liquid receptacle and the housing of the condensate pump assembly cooperate to hold the liquid receptacle in the first position, without also requiring a removable cover.

The housing may comprise a shroud portion extending over a side wall of the liquid receptacle, whereby to hide the side wall of the liquid receptacle from view when the liquid receptacle is in the first position in the housing. The shroud portion may extend over all side walls of the liquid receptacle. Thus, a separate removable cover of the condensate pump assembly is not required for aesthetic reasons to hide the liquid receptacle from view when in the first position in the housing.

The selective release means may comprise at least one snap-fit joint. The selective release means may comprise a resilient member biased to hold the liquid receptacle in the first position and movable to release the liquid receptacle for movement from the first position towards the second position. The selective release means may comprise a peg member configured, in use, to apply a force against the housing to secure the liquid receptacle when attached to the housing.

This, in itself, is believed to be novel and so, in accordance with a further aspect of the present disclosure, there is provided a condensate pump assembly for use in an air conditioning system, the condensate pump assembly comprising a pump arranged in a housing to pump liquid from a liquid inlet to a liquid outlet; a liquid receptacle configured to receive liquid from the liquid inlet. The liquid receptacle may be releasably secured to the housing by selective release means. The selective release means may comprise a peg member configured, in use, to apply a force against the housing to secure the liquid receptacle when attached to the housing. The selective release means may comprise a resilient member biased to hold the liquid receptacle in the first position and movable to release the liquid receptacle for movement from the first position towards the second position.

The liquid receptacle may comprise a support member configured to resist bending of the peg member. The liquid receptacle may be configured to be releasable by a hand of a user.

The release means may be operable by either hand of the user. Thus, the condensate pump assembly may be mountable to a wall surface in either of two rotational positions, spaced by 180 degrees, depending on the particular space availability in the vicinity of a connected air conditioning unit. The release means can be operated whether the condensate pump assembly is mounted in a first configuration, or a second configuration, rotated by 180 degrees relative to the first configuration about an axis aligned with a direction of gravity in use. This means the same tooling can be used to produce at least some components of the condensate pump assembly which are suitable for use in either of the first configuration or the second configuration.

The release means may be operable by squeezing. The release means may be operable by squeezing a thumb of the hand towards a finger of the hand. Thus, the liquid receptacle can be easily removed and can be gripped with one hand as part of operating the release mechanism to prevent any spillage during movement of the liquid receptacle from the first position towards the second position.

A shroud portion of the housing may be substantially opaque. Thus, the liquid receptacle can be substantially hidden from view in the first position. A base portion of the liquid receptacle may be substantially opaque.

The pump may be a reciprocating pump. It will be appreciated that other types of pump may instead be used, such as a centrifugal pump. However, vibration of the condensate pump assembly is typically more of a problem with a reciprocating pump than with other types of pump.

The housing may comprise at least one mounting point for mounting the condensate pump assembly to a wall. An axis of reciprocation of the reciprocating pump may be arranged to be substantially parallel to the wall when the condensate pump assembly is mounted to the wall. In embodiments, the housing may comprise a plurality of mounting points for mounting the condensate pump assembly in either of a first configuration, or a second configuration, the second configuration being rotated by 180 degrees relative to the first configuration about an axis aligned with a direction of gravity when the condensate pump assembly is mounted to the wall.

The condensate pump assembly may further comprise a liquid level sensor configured to detect a liquid level in the liquid receptacle when the liquid receptacle is in the first position. The condensate pump assembly may further comprise a pump controller configured to operate the pump when the liquid level sensor outputs a first signal indicative of a liquid level within the liquid receptacle above a level of the liquid inlet to the pump and to stop the pump when the liquid level sensor outputs a second signal indicative of a liquid level within the liquid receptacle approaching or below a level of the liquid inlet to the pump.

The liquid receptacle may comprise a filter to separate a first reservoir from a second reservoir, wherein the condensate inlet is arranged to provide liquid into the first reservoir and the liquid inlet is in fluid communication with the first reservoir via the filter and the second reservoir.

Thus, any contaminants (such as dirt) unable to pass through the filter will remain in the first reservoir and will not be transferred to the second reservoir through the filter. This ensures that contaminants do not enter the pump and cause damage.

The liquid receptacle may comprise a weir in the first reservoir and extending from a base portion of the liquid receptacle. Thus, any contaminants in the condensate liquid having a density greater than a bulk density of the condensate liquid will be caught by the weir and will not even encounter the filter. In embodiments, the liquid receptacle may comprise a weir in each of the first reservoir and the second reservoir.

The liquid receptacle may be formed from an inner portion and an outer portion, whereby to provide a double-walled thermally insulated liquid receptacle. The inner portion may be slidably removable from the outer portion.

The filter may be formed from a resilient material, and flexible such that the filter may be secured, in a bowed configuration, within either the inner portion of the liquid receptacle or the outer portion of the liquid receptacle. Thus, the same filter can be used for condensate pump assemblies both with and without the inner portion of the liquid receptacle.

Viewed from another aspect, the present disclosure provides a kit of parts for assembling a condensate pump assembly. The kit of parts comprises: a housing; a pump to be arranged in the housing and operable to pump liquid from a liquid inlet towards a liquid outlet; and a liquid receptacle for insertion into a first position in the housing to receive condensate from a condensate inlet of the housing and to be in fluid communication with the liquid inlet. The liquid receptacle is movable from the first position into a second position, removed from the housing, whereby to empty the liquid receptacle. One or both of the housing or the liquid receptacle comprise selective release means operable by a hand of a user to release the liquid receptacle for movement from the first position towards the second position.

BRIEF DESCRIPTION OF THE DRAWINGS

Embodiments of the invention are further described hereinafter with reference to the accompanying drawings, in which.

DETAILED DESCRIPTION

Figure 1:
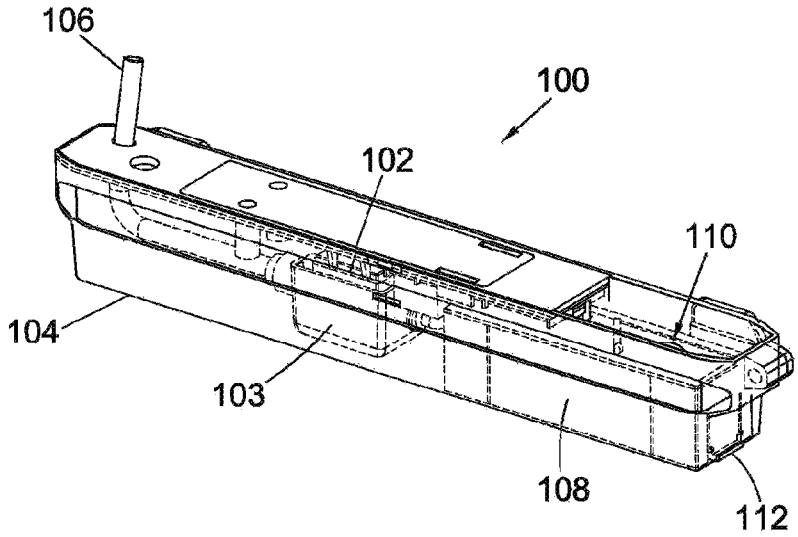
FIG. 1 is an illustration of a condensate pump assembly with a portion of the housing shown transparent.

FIG. 1 is an illustration of a condensate pump assembly with a portion of the housing shown transparent. The condensate pump assembly 100 comprises a housing 104 to contain a pump in the form of a reciprocating pump 102 (not shown in FIG. 1) mounted within an anti-vibration motor mount 103. The anti-vibration motor mount 103 is typically formed from rubber. Thus, the anti-vibration motor mount 103 damps vibration in the condensate pump assembly 100 caused by operation of the reciprocating pump 102. It will be understood that the reciprocating pump 102 may be damped in other ways, for example through other components connecting the reciprocating pump 102 to the housing 104 of the condensate pump assembly 100. In some examples, the reciprocating pump 102 need not use any damping. The housing 104 is typically formed from plastics. The reciprocating pump 102 is arranged to pump liquid from a liquid inlet (not shown in FIG. 1) to a liquid outlet 106. The reciprocating pump 102 is a well-known pump and the skilled person would readily understand how to provide such a pump. A reciprocating axis of the reciprocating pump 102 is aligned with a longitudinal direction of the condensate pump assembly 100. Thus, a height and a depth (distance away from the wall when mounted) of the condensate pump assembly 100 can be small. When the condensate pump assembly 100 is installed as part of an air conditioning system, the liquid outlet 106 is in fluid communication with a liquid drain (not shown) so that excess liquid can be removed from the air conditioning system.

The condensate pump assembly 100 further comprises a liquid receptacle in the form of an open-topped, rectangular container 108. The container 108 comprises a base portion and four walls (not labelled in FIG. 1). An upper portion of the container 108 is open to receive condensate from an air conditioning unit (not shown) via a condensate inlet 110. In this example, the condensate inlet 110 is defined by an opening in an upper surface of the housing 104. The liquid receptacle 108 is movable from a first position, as shown in FIG. 1, to a second position removed from the housing 104. In the first position, the liquid receptacle 108 is provided at a first longitudinal end of the condensate pump assembly 100, opposite an end of the condensate pump assembly 100 having the reciprocating pump 102 and the liquid outlet 106. In the second position, the liquid receptacle 108 can be cleaned or emptied of liquid to remove any contaminants from the liquid receptacle 108. The condensate pump assembly 100 further comprises selective release means in the form of a first resilient clip 112 and a second resilient clip (not shown in FIG. 1). The resilient clips 112, 114 can be operated by a user's hand to release the liquid receptacle 108 for movement from the first position towards the second position. The operation and function of the selective release means will be described further in relation to FIGS. 2 and 3 below.

Figure 2:
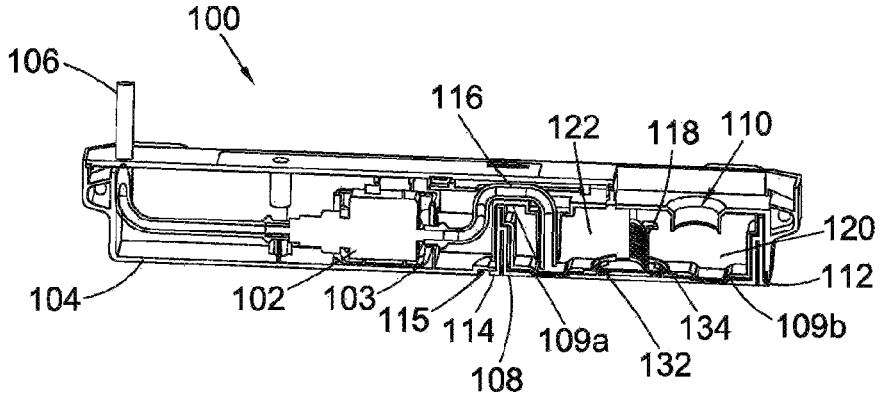
FIG. 2 is a cross-sectional view of the condensate pump assembly shown in FIG. 1.
Figure 6:
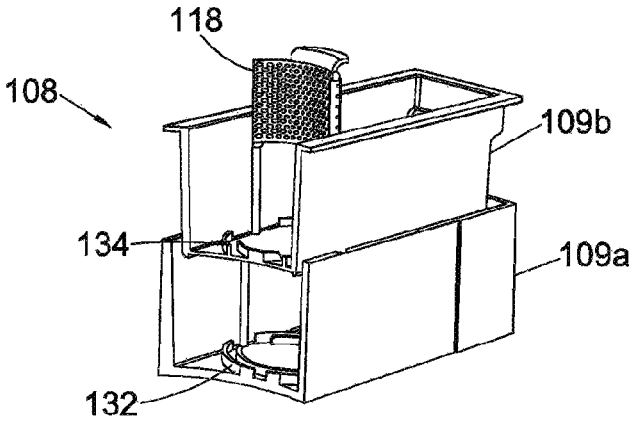
FIG. 6 is an exploded cross-sectional view of the liquid receptacle shown in the condensate pump assembly shown in FIGS. 1 to 5.

FIG. 2 is a cross-sectional view of the condensate pump assembly shown in FIG. 1. The cross-sectional view of the condensate pump assembly 100 is taken through a vertical plane aligned along a longitudinal axis of the condensate pump assembly 100. Thus, it is possible to illustrate an internal pathway for liquid from the condensate inlet 110 to the liquid outlet 106 via the liquid receptacle 108, a liquid inlet 116 and the reciprocating pump 102. As will be appreciated from FIG. 2, and also from FIG. 6, described in more detail below, the liquid receptacle 108 in this example, is insulated. In particular, the liquid receptacle 108 is formed from a double walled construction, comprising an outer portion 109*a* and an inner portion 109*b*. The inner portion 109*b* is arranged to be removably and slidably mounted within the outer portion 109*a*. Thus, the double walled construction provides thermal insulation of any contents within the liquid receptacle 108 from an external environment of the condensate pump assembly 100. This prevents formation of condensation on an outer surface of the housing 104 of the condensate pump assembly, particularly in hot and/or humid environments where the temperature difference between the housing 104 and the condensate within the liquid receptacle 108 may be significant. If condensation were to form, this may drip off the housing 104 and be unsightly and unhygienic. In some examples, it will be understood that the outer portion 109*a* only of the liquid receptacle 108 may be provided, where insulation is not required (for example in cooler and/or drier environments. When the liquid receptacle 108 is provided in the first position, as shown in FIG. 2, the liquid receptacle 108 is in the housing 104 and can receive condensate from the condensate inlet 110. The liquid receptacle 108, in the first position, is also in fluid communication with the liquid inlet 116. In use, liquid, typically condensate water from the air conditioning unit, enters the liquid receptacle 108 through a drainage tube (not shown) connected to the condensate inlet 110. The liquid enters a first reservoir 120 defined by an internal wall of the liquid receptacle 108 and a filter 118. The liquid receptacle 108 is also illustrated in the exploded cross-section view shown in FIG. 6. The filter 118 has a length along the surface of the filter in a direction across the liquid receptacle 108 greater than the distance between the facing walls of the liquid receptacle 108. This ensures that the cross-sectional area of the filter 118 is greater than the cross-sectional area of the distance directly across the liquid receptacle 108 whereby to improve the capacity of the filter 118. In this example, the filter 118 is formed from a resilient material and has a curved shape relative to the first reservoir 120 and an overturned lip at a free end thereof. The resilient material and curved shape of the filter 118 allows the same filter 118 to be used regardless of whether the liquid receptacle 108 comprises the outer portion 109*a* and the inner portion 109*b*, or just the outer portion 109*a*. The filter 118 ensures any particulates in the condensate received from the condensate inlet 110 do not pass to the liquid inlet 116 and onwards to the reciprocating pump 102. In this example, the filter 118 is porous to particles of less than 0.9 millimetre in diameter, and is provided by a filter member having a plurality of holes defined therein, each hole having a diameter of approximately 0.9 millimetres. It will be understood that other filter types and/or hole sizes may be used. The overturned lip can be used as a handle to easily remove and insert the filter 118 relative to the liquid receptacle 108, for cleaning and/or replacement. In this example, the filter 118 is convexly curved relative to the first reservoir 120 and the overturned lip extends towards the first reservoir 120. However, it will be understood that the filter 118 may alternatively have a concave shape relative to the first reservoir 120. The filter 118 separates the first reservoir 120 from a second reservoir 122. In this way, the first reservoir 120 is in fluid communication with the second reservoir 122 via the filter 118. In this example, the filter 118 has a concave shape relative to the second reservoir 122 and the overturned lip at the free end thereof, extends away from the second reservoir 122. However, as above, it will be understood that the filter 118 may alternatively have a convex shape relative to the second reservoir 122. The second reservoir 122 is downstream of the first reservoir 120, arranged to contain liquid received from the condensate inlet 110 and filtered by the filter 118.

The liquid receptacle 108 is also provided with a weir 132, 134 extending from a base portion thereof whereby to prevent the passage of contaminants having a density greater than a bulk density of the condensate. In this example, each of the outer portion 109*a* and the inner portion 109*b* of the liquid receptacle 108 is provided with a weir 132, 134 respectively, extending up from a base surface thereof. A height of the weirs 132, 134 is around 2.5 millimetres, and is such that the inner portion 109*b* can be mounted within the outer portion 109*a* without significant reduction of the available volume of the liquid receptacle 108. It will be understood that the height of the weirs 132, 134 may be greater or lesser, depending on the particles to be stopped by the weirs 132, 134. In this example, the weirs 132, 134 are formed as two substantially concentric, semi-annular protrusions from the base portion of each of the outer portion 109*a* and the inner portion 109*b* respectively. It will be understood that a different number and/or shape of weirs 132, 134 may be used. Further, the weirs 132, 134 are arranged on both sides of the filter 118. The weirs 132, 134 act to prevent the onward passage of any foreign objects or contaminants, having a density greater than a bulk density of the condensate, into the reciprocating pump 102.

In this way, none, or at least very few foreign objects or contaminants from the air conditioning unit pass to the second reservoir 122 of the liquid receptacle 108. The liquid inlet 116 is formed from a hollow tube having an open end and extending substantially downwards within the second reservoir 122 to a depth below a height of the filter 118. The hollow tube enters the second reservoir 122 of the liquid receptacle 108 through an open upper portion of the liquid receptacle 108. In this example, the open end of the liquid inlet 116 extends to a position over half of the height of the filter 118. Thus, the liquid inlet 116 can extract liquid from the liquid receptacle 108 up to a depth of the open end of the liquid inlet 116. The hollow tube forming the liquid inlet 116 is connected, at an end opposite the open end, to the reciprocating pump 102. On operation of the reciprocating pump 102, the liquid is drawn from the second reservoir 122 of the liquid receptacle 108 via the liquid inlet 116. The liquid is pumped out of the condensate pump assembly 100 through the liquid outlet 106 by the reciprocating pump 102. Operation of the reciprocating pump 102 of the condensate pump assembly 100 is explained more fully with reference to FIG. 5 below.

The liquid receptacle 108 can be released from the first position for movement towards the second position by operation of the selective release means in the form of the a first resilient member 112 and a second resilient member 114. The resilient members 112, 114 are biased to hold the liquid receptacle 108 in the first position within the housing 104. In particular, the resilient members 112, 114 are in the form of a first resilient clip 112 and a second resilient clip 114 connected to a side wall of the liquid receptacle 108 and extending towards a base surface of the condensate pump assembly 100. Each of the resilient clips 112, 114 is biased outwardly against a corresponding lip (not shown) provided on the housing 104, whereby to secure the liquid receptacle 108 in the first position in the housing 104. The outwardly biased resilient clips 112, 114 exert a pressure against the respective corresponding lips provided on the housing 104, whereby to substantially prevent any rattle of the liquid receptacle 108 in the housing 104 when the liquid receptacle is secured in the first position in the housing 104. In effect, the resilient clips 112, 114 act as a form of shock absorber to substantially eliminate any rattle of the liquid receptacle 108 in the housing 104. A finger recess 115 is defined in a base surface of the housing 104, whereby to allow a finger or thumb of a user to engage with an outer side of the second resilient clip 114. By squeezing the resilient clips 112, 114 together using opposing digits on a hand of a user, the resilient clips 112, 114 can both be disengaged from their respective lips at substantially same time, in a single movement of the hand, releasing the liquid receptacle 108 for movement from the first position towards the second position. The movement of the liquid receptacle 108 after disengagement of the resilient clips 112, 114 from the respective corresponding lips on the housing 104 is substantially downwards in use. It will be understood that the selective release means is operable by any one of the hands of a user, and does not require both hands of a user, neither does such operation require one particular hand of the user. Furthermore, squeezing the resilient clips 112, 114 also serves to grip the liquid receptacle 108 securely in the hand of a user, preventing accidental spillage of the contents thereof. In the present example, the resilient clips 112, 114 can be squeezed between a thumb and forefinger of the same hand for to release the liquid receptacle 108 from the first position.

In this example, it will be appreciated that the liquid receptacle 108 is symmetric about a plane of symmetry across the liquid receptacle 108 and transverse to a direction of liquid flow through the liquid receptacle 108. Thus, the liquid receptacle 108 can be mounted within the housing 102 in one of two rotational positions.

Figure 3:
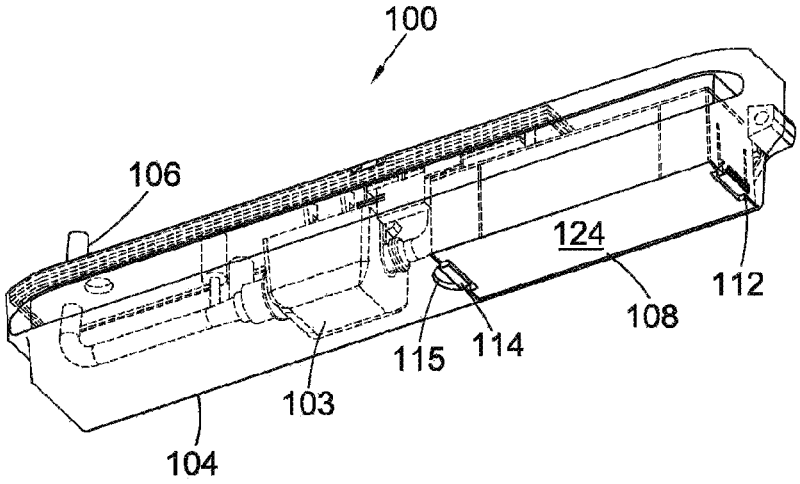
FIG. 3 is a further illustration of the condensate pump assembly shown in FIGS. 1 and 2, with the same portion of the housing shown transparent as in FIG. 1.

FIG. 3 is a further illustration of the condensate pump assembly shown in FIGS. 1 and 2, with the same portion of the housing shown transparent as in FIG. 1. In particular, FIG. 3 shows the condensate pump assembly 100 from beneath, showing a base portion 124 of the liquid receptacle 108. The base portion 124 is substantially opaque such that a user cannot see contents of the liquid receptacle 108 through the base portion 124. Furthermore, the base portion 124 forms an outer surface of the condensate pump assembly 100. In normal operation of the condensate pump assembly 100 when connected to an air conditioning unit, no additional cover is required to support and hide the liquid receptacle 108. In this example, the liquid receptacle 108 is formed from plastics. The liquid receptacle in this example is formed from the same plastics material as the housing 104 of the condensate pump assembly 100.

Figure 4:
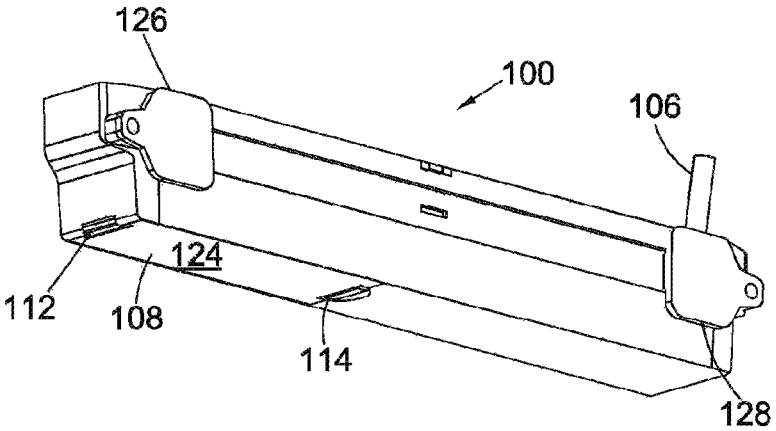
FIG. 4 is a yet further illustration of the condensate pump assembly shown in FIGS. 1 to 3, showing mounting portions of the condensate pump assembly.

FIG. 4 is a yet further illustration of the condensate pump assembly shown in FIGS. 1 to 3, showing mounting portions of the condensate pump assembly. A first longitudinal side wall of the condensate pump assembly 100 is provided with a first mounting portion in the form of a first mounting point 126 and a second mounting portion in the form of a second mounting point 128. The first mounting point 126 and the second mounting point 128 are usable to affix the condensate pump assembly 100 to a wall of a room or building, below the air conditioning unit of the air conditioning system. Alternatively, the first mounting point 126 and the second mounting point 128 can be provided on a second longitudinal side wall of the condensate pump assembly 100, opposite the first longitudinal side wall, whereby to mount the condensate pump assembly 100 after rotation by 180 degrees about an axis aligned with a direction of gravity. In this way, the condensate pump assembly 100 can be mounted such that the liquid receptacle 108 is provided at either a left or a right side of the condensate pump assembly 100, when the condensate pump assembly 100 is mounted to a wall of the room or building containing the air conditioning unit. This is particularly useful in space-constrained environments where accessibility to the condensate pump assembly 100 may be difficult. In this example, the first mounting point 126 and the second mounting point 128 are formed from rubber to function as an anti-vibration mount, damping any vibration of the condensate pump assembly 100 caused by operation of the reciprocating pump 102. Furthermore, as has been explained above, the liquid receptacle 108 can be released from the first position by operation of the resilient clips 112, 114 by either hand of the user. Thus, depending on convenience, the same condensate pump assembly 100 can be mounted to the wall in either a first rotational position or a second rotational position, rotated by 180 degrees from the first rotational position about an axis aligned with a direction of gravity. The same condensate pump assembly 100 can also be operated by either hand of a user in each of the first and second rotational positions. This helps to reduce manufacturing costs, since only a single design of condensate pump assembly 100 need be produced, for a range of different room designs.

Figure 5:
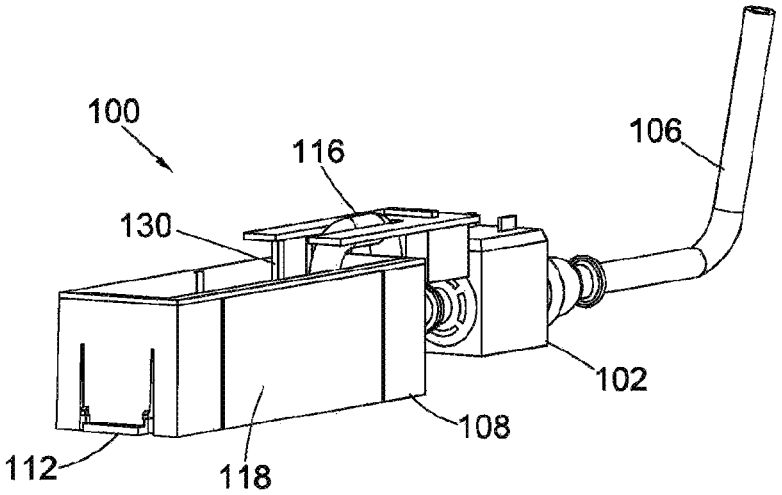
FIG. 5 is an illustration showing internal components of the condensate pump assembly shown in FIGS. 1 to 4.

FIG. 5 is an illustration showing internal components of the condensate pump assembly shown in FIGS. 1 to 4. The condensate pump assembly 100 further comprises a liquid level sensor 130 configured to detect a liquid level in the liquid receptacle 108 when the liquid receptacle 108 is in the first position. In this example, the liquid level sensor 130 is a dip-sensor configured to output a signal indicative of the liquid level within the second reservoir 122 of the liquid receptacle 108 by being responsive to a covering of at least a portion of the liquid level sensor 130 by liquid in the second reservoir 122. In this example, the liquid level sensor 130 is a capacitive liquid level sensor 130 arranged to output a signal indicative of the liquid level within the second reservoir 122 of the liquid receptacle 108 based on a change in capacitance of the medium in contact with a portion of the liquid level sensor 130. It will be appreciated, however, that another type of liquid level sensor may be used instead.

The condensate pump assembly 100 further comprises a pump controller (not shown). The pump controller may be implemented in hardware or software, or a combination of both. The pump controller is configured to operate the pump 102 when the liquid level sensor 130 outputs a first signal indicative of a liquid level within the liquid receptacle 108 at least a predetermined amount above a level of the open end of the liquid inlet 116 and to stop the pump 102 when the liquid level sensor 130 outputs a second signal indicative of a liquid level within the liquid receptacle 108 approaching or below a level of the liquid inlet 116. The pump controller is also configured to output a warning when the liquid level sensor 130 outputs a warning signal indicative of a liquid level within the liquid receptacle 130 above a predetermined warning level within the liquid receptacle 108. The air conditioning system is configured to stop operation of the air conditioning unit in response to the warning output.

Figure 7:
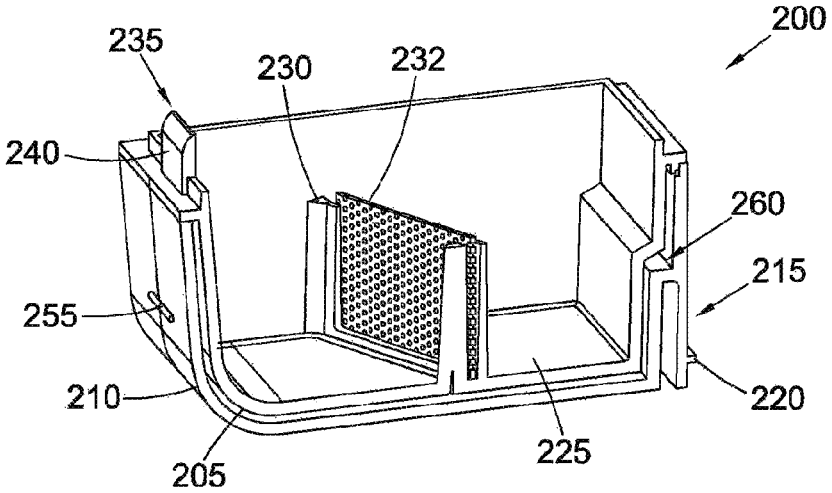
FIG. 7; is a cross-sectional view of an alternative liquid receptacle according to another embodiment.
Figure 8:
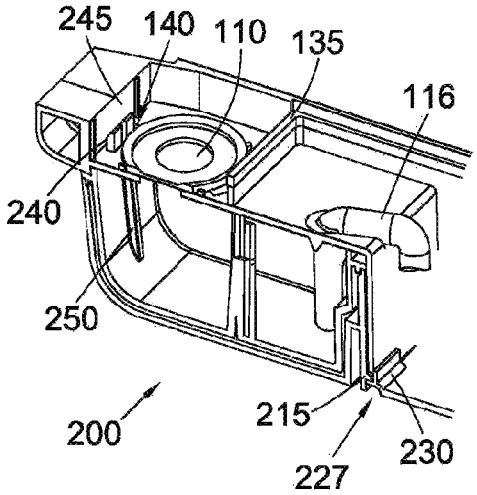
FIG. 8; is a cross-sectional view of the liquid receptacle end of the condensate pump assembly, showing the liquid receptacle of FIG. 7 clipped in position.
Figure 9:
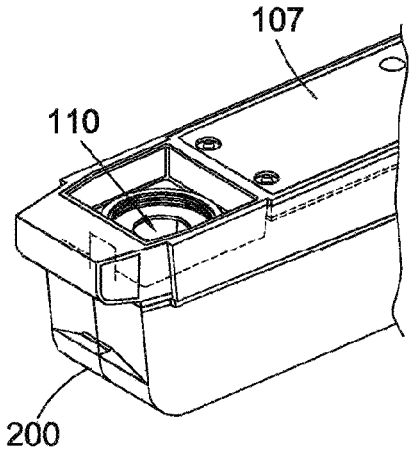
FIG. 9 is a top perspective view of the receptacle end of the condensate pump assembly, showing the liquid receptacle of FIG. 7 clipped in position.

FIGS. 7, 8 and 9 illustrate an alternative embodiment. FIG. 7 is a cross-sectional view of the liquid receptacle 200 of this alternative embodiment. An upper portion of the liquid receptacle 200 is open to receive condensate from an air conditioning unit (not shown) via the condensate inlet 110. The liquid receptacle 200 is shown having an inner wall 205 and an outer wall 210 sealed together to form an insulating gap 260 extending around substantially the entire outer surface of the inner wall 205. By surrounding the inner wall 205 the insulating gap 260, the insulating effects are maximised and the risk of condensate forming on the outer surface of the outer wall 210 is minimised. Preferably the insulating gap 260 is filled with air. However, other gaseous compositions or insulating material may be included within the insulating gap 260.

A pair of support members 230 is also shown extending from the base surface 225 and configured to secure a filter 232 within the liquid receptacle 200. By placing the filter 232 in the fluid flow path between the fluid inlet and the pump and securing the filter 232 such that the filter 232 extends across the width of the liquid receptacle, larger particulate debris can be prevented from reaching the pump 102. The filter 232 has a length along the surface of the filter 232 in a direction across the liquid receptacle 200 greater than the distance between the facing walls of the liquid receptacle 200. This ensures that the cross-sectional area of the filter 232 is greater than the cross-sectional area of the distance directly across the liquid receptacle 200 whereby to improve the capacity of the filter 232. While the filter 232 is shown comprising a plurality of circular holes, it would be apparent that other shapes of holes may be used. While a pair of supports members 230 have been shown, it would be apparent that other arrangements may be used to secure the filter 232. Such arrangements may include more or fewer than two extending members 230. The filter 232 may be secured to the underside of an upper housing portion 107 or the base surface 225 of the liquid receptacle 200. A seal is formed between the upper housing portion 107 and housing 104 by a gasket 135. The filter 232 may be secured by slots or grooves within the surfaces that define the liquid receiving volume. This filter arrangement may be used in place of the filter arrangement of the embodiment illustrated in FIGS. 1 to 6 and vice versa.

The liquid receptacle 200 is secured to the housing 104 by selective release means. The selective release means allows the liquid receptacle 200 to be movable from a first position, as shown in FIGS. 8 and 9, to a second position removed from the housing 104. As shown in FIG. 7, the selective release means may include a resilient clip 215 and a peg 235 at the opposite end of the liquid receptacle 200 configured, in use, to apply a force against the housing 104 to secure the liquid receptacle 200 when attached to the housing 104. The force may be applied against an inner surface 245 of the housing 104 via an outer surface 240 of the peg 235. The peg 235 used to secure the liquid receptacle 200 to the housing 105 may protrude through a cutaway 140. The illustrated arrangement allows a user to remove the liquid receptacle 200 from the housing 104, for example to clear the filter 232 of debris, by squeezing their thumb and finger together. This means a user is able to remove the liquid receptacle 200 using only a single hand. For example, the user is able to remove the liquid receptacle 200 by squeezing together their thumb and finger of their left or right hand. By enabling the removal of the liquid receptacle 200 with either hand, the flexibility of the present arrangement is further improved. The action of squeezing the thumb and finger together releases the resilient clip 215 from the housing 104 and releases a protrusion 220 of the resilient clip 215 from the corresponding recess 230 in the housing 104 (see also FIG. 8) used to secure the liquid receptacle 200 in the housing 104. By squeezing the resilient clip 215 and outer wall 210 using opposing digits on a hand of a user, the resilient clip 215 can be disengaged from its respective lip, and in a single movement of the hand, release the liquid receptacle 200 for movement from the first position towards the second position. The movement of the liquid receptacle 200 after disengagement of the resilient clip 215 is substantially downwards in use. It will be understood that the selective release means is operable by any one of the hands of a user, and does not require both hands of a user, neither does such operation require one particular hand of the user. That is to say, the left or right hand of the user may be used to operate the selective release means. Furthermore, squeezing the resilient clip 215 and outer wall 210 also serves to grip the liquid receptacle 200 securely in the hand of a user, preventing accidental spillage of the contents thereof. In the present example, the resilient clip 215 and outer wall 210 can be squeezed between a thumb and forefinger of the same hand for to release the liquid receptacle 200 from the first position. The outwardly biased resilient clip 215 and peg 235 exert a pressure against the respective corresponding recess 230 and inner wall 245, whereby to substantially prevent any rattle of the liquid receptacle 200 in the housing 104 when the liquid receptacle 200 is secured in the first position in the housing 104. The user's thumb or finger may be received by a slot 227 in the housing 104 to enhance the user's grip on the liquid receptacle 200 prior to squeezing the resilient clip 215. The outer wall 210 may have a protrusion 255 to further enhance the user's grip on the liquid receptacle 200. The thumb or finger of a user may rest on the protrusion 255 when removing the liquid receptacle 200 from the housing 104. The peg 235 may be stiffened by a support member 250 extending from the inner wall 205. The peg 235 may have a first longitudinal axis and the support member 250 may have a second longitudinal axis and the first longitudinal axis may be substantially parallel to the second longitudinal axis. The support member 250 may extend the length of the peg 235. While a resilient clip 215, in the form of a cantilever joint, and peg 235 are illustrated here, it would be apparent that other releasable joints may be used to secure the liquid receptacle 200. While a protrusion 255 in the form of a horizontal bar is illustrated in FIGS. 7 and 9, it would be apparent that other arrangements to enhance the user's grip on the outer wall 210 are possible. Outer wall 210 may include one or more high friction materials to enhance the user's grip on the outer wall 210. For example, the outer wall may include one or more rubberised sections. The outer wall may be made from one or more thermally insulating materials, such as plastic.

In summary, there is provided a condensate pump assembly (100) for use in an air conditioning system. The condensate pump assembly (100) comprises a pump (102) arranged in a housing (104) to pump liquid from a liquid inlet (116) towards a liquid outlet (106). The condensate pump assembly (100) further comprises a liquid receptacle (108) arranged, in a first position in the housing (104), to receive condensate from a condensate inlet (110) and to be in fluid communication with the liquid inlet (116). The liquid receptacle (108) is movable to a second position removed from the housing (104), whereby to empty the liquid receptacle (108). The condensate pump assembly (100) further comprises selective release (112, 114) means operable by a hand of a user to release the liquid receptacle (108) for movement from the first position towards the second position.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A condensate pump assembly for use in an air conditioning system, the condensate pump assembly comprising:

a pump arranged in a housing to pump liquid from a liquid inlet towards a liquid outlet;

a liquid receptacle arranged, in a first position in the housing, to receive condensate from a condensate inlet and to be in fluid communication with the liquid inlet, the liquid receptacle movable to a second position removed from the housing, whereby to empty the liquid receptacle; and a release operable from a base surface of the condensate pump assembly by a hand of a user squeezing a thumb of the hand towards a finger of the hand to release the liquid receptacle for movement from the first position towards the second position when the condensate pump assembly is mounted for use.

2. The condensate pump assembly as claimed in claim 1, wherein the release comprises a resilient member biased to hold the liquid receptacle in the first position and movable to release the liquid receptacle for movement from the first position towards the second position.

3. The condensate pump assembly as claimed in claim 2, wherein the resilient member is provided on the liquid receptacle and is biased to engage with a corresponding lip provided on the housing.

4. The condensate pump assembly as claimed in claim 1, wherein the liquid receptacle is secured in the first position only by the release.

5. The condensate pump assembly as claimed in claim 1, wherein a base portion of the liquid receptacle provides an outer surface of the condensate pump assembly.

6. The condensate pump assembly as claimed in claim 1, wherein the housing comprises a shroud portion extending over a side wall of the liquid receptacle, whereby to hide the side wall of the liquid receptacle from view when the liquid receptacle is in the first position in the housing.

7. The condensate pump assembly as claimed in claim 1, wherein the release comprises at least one snap-fit joint at a first end of the liquid receptacle.

8. The condensate pump assembly according to any preceding claim, wherein the release comprises a peg member at a second end opposed to a first end of the liquid receptacle, and wherein the peg member is configured, in use, to apply a force against the housing to secure the liquid receptacle when attached to the housing.

9. The condensate pump assembly as claimed in claim 8, wherein the release comprises a support member configured to resist bending of the peg member.

10. The condensate pump assembly as claimed in claim 1, wherein the release is operable by either hand of the user.

11. The condensate pump assembly as claimed in claim 1, wherein the pump is a reciprocating pump.

12. The condensate pump assembly as claimed in claim 11, wherein the housing comprises at least one mounting point for mounting the condensate pump assembly to a wall, and wherein an axis of reciprocation of the reciprocating pump is arranged to be substantially parallel to the wall when the condensate pump assembly is mounted to the wall.

13. A condensate pump assembly, comprising:

a pump arranged in a housing to pump liquid from a liquid inlet towards a liquid outlet;

a liquid receptacle arranged, in a first position in the housing, to receive condensate from a condensate inlet and to be in fluid communication with the liquid inlet, the liquid receptacle movable to a second position removed from the housing, whereby to empty the liquid receptacle;

a release operable by a hand of a user to release the liquid receptacle for movement from the first position towards the second position;

a liquid level sensor configured to detect a liquid level in the liquid receptacle when the liquid receptacle is in the first position; and a pump controller configured to operate the pump when the liquid level sensor outputs a first signal indicative of a liquid level within the liquid receptacle above a level of the liquid inlet to the pump and to stop the pump when the liquid level sensor outputs a second signal indicative of a liquid level within the liquid receptacle approaching or below the level of the liquid inlet to the pump.

14. A kit of parts for assembling a condensate pump assembly comprising:

a housing;

a pump to be arranged in the housing and operable to pump liquid from a liquid inlet towards a liquid outlet; and a liquid receptacle for insertion into a first position in the housing to receive condensate from a condensate inlet of the housing and to be in fluid communication with the liquid inlet, the liquid receptacle movable from the first position into a second position, removed from the housing, whereby to empty the liquid receptacle, wherein one or both of the housing or the liquid receptacle comprise a release operable from a base surface of the condensate pump assembly by a hand of a user squeezing a thumb of the hand towards a finger of the hand to release the liquid receptacle for movement from the first position towards the second position; when the condensate pump assembly is mounted for use.

* * * * *